US012448245B2

(12) United States Patent
Becerra Alvarado et al.

(10) Patent No.: US 12,448,245 B2
(45) Date of Patent: Oct. 21, 2025

(54) REEL BUCK APPARATUS

(71) Applicant: Jameson, LLC, Clover, SC (US)

(72) Inventors: Carlos Fernando Becerra Alvarado, Charlotte, NC (US); Brent Wagner, Bartlett, IL (US)

(73) Assignee: Jameson, LLC, Clover, SC (US)

( * ) Notice: Subject to any disclaimer, the term of this patent is extended or adjusted under 35 U.S.C. 154(b) by 155 days.

(21) Appl. No.: 18/520,678

(22) Filed: Nov. 28, 2023

(65) Prior Publication Data

US 2024/0174476 A1 May 30, 2024

Related U.S. Application Data

(60) Provisional application No. 63/385,418, filed on Nov. 30, 2022.

(51) Int. Cl.
*B65H 49/32* (2006.01)

(52) U.S. Cl.
CPC ..... *B65H 49/32* (2013.01)

(58) Field of Classification Search
CPC .... B65H 49/32; B65H 49/321; B65H 49/324; B65H 49/325
See application file for complete search history.

(56) References Cited

U.S. PATENT DOCUMENTS 3,069,110 A * 12/1962 Domer ..... B65H 49/32 242/129.6
3,304,060 A * 2/1967 Davenport ..... B21C 47/24 254/131
4,391,422 A * 7/1983 McDonald ..... B62B 1/264 242/129.6
4,746,078 A * 5/1988 Setzke ..... B65H 49/321 242/129.6
4,932,601 A * 6/1990 Arrington ..... B65H 49/32 242/598.5
5,775,621 A * 7/1998 Sauber ..... B65H 49/32 242/391.1
6,299,100 B1 * 10/2001 Cloud ..... B65H 49/32 242/391.1

* cited by examiner

*Primary Examiner* — Sang K Kim
(74) *Attorney, Agent, or Firm* — Shumaker, Loop & Kendrick, LLP; S. Alexander Long, Jr.; Brian D. MacDonald

(57) ABSTRACT

An inventive reel carrier and stand apparatus, termed a reel buck, provides a quick and easy way to set up strand and cable reels, examples of which may vary in diameter. The apparatus can be assembled and disassembled, and can be stored, transported, and shipped in a space efficient essentially flat configuration. The apparatus is designed to be easily moved about a job site, handling the apparatus using ergonomically oriented handles on the frame while a mounted spool serves as a wheel. The reel buck is collapsible upon disassembly for quick loading and has multiple mounting positions to accommodate various spool sizes.

11 Claims, 5 Drawing Sheets

REEL BUCK APPARATUS

CROSS-REFERENCE TO RELATED APPLICATION

This application claims the benefit of priority of U.S. provisional patent application No. 63/385,418, titled "Reel Buck Apparatus," filed on Nov. 30, 2023, which is incorporated herein in its entirety by this reference.

TECHNICAL FIELD

The present disclosure relates to construction materials handling equipment. More particularly, the present disclosure relates to an apparatus for moving a cable or line reel or spool and supporting the reel or spool for accessing the cable or line.

BACKGROUND

Large spools of cable or line, typically termed reels, can weigh hundreds of pounds and thus require an apparatus for movement and support. Once a reel does arrive at a convenient location for use, support is needed to facilitate dispensation of the stock cable or line by unwinding from the reel. A convenient device termed a reel buck serving both movement and stock dispensation is in use in the field. However, the handling of some such devices is non-optimal for human anatomy, particularly wrists. Also, available devices are typically bulky without convenient disassembly to any condition feasible for typical shipping services and/or their preferred packaging requirements. Both consumers and businesses are increasingly tending to acquire products via online marketplaces. Whether products are stocked in marketplace warehouses or drop shipped, even traditionally bulky items and items typically transacted business-to-business are under market pressure toward convenient shipping possibilities.

Specialized lift and roll devices, such as reel buck, are needed.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

An apparatus for supporting and rolling a reel or spool, according to at least embodiment, includes two frame assemblies positioned side-by-side in an assembled condition of the apparatus, and a support axle for mounting a reel or spool thereon, the support axle attached to each one of the two frame assemblies. Each frame assembly includes a rigidly fixed handle for tilting and handling the apparatus, each handle extending parallel to the support axle.

Each said handle extends toward the other said handle.

In some examples, each handle extends into a space defined between the two frame assemblies and spanned by the support axle.

Each of the two frame assemblies may include a handling beam to which the respective handle is rigidly fixed, and a reel support beam to which the support axle is attached, the reel support beam being connected to the handling beam.

For each of the two frame assemblies, the handling beam may have a proximal end connected to a proximal end of the reel support beam, and a distal end to which the respective handle is rigidly fixed.

For each of the two frame assemblies, an acute angle may be defined between the handling beam and the support beam.

Each of the two frame assemblies may include a rigid truss bar diagonally spanning a space between medial portions of the handling beam and the reel support beam.

For each of the two frame assemblies, the respective handle may be rigidly fixed on a side of the handling beam facing a direction in which the reel support beam extends.

For each of the two frame assemblies, the respective handle is offset from, and extends perpendicular to, a longitudinal axis of the handling beam.

The apparatus in some examples has a standing position in which the apparatus is supported at least in part by the distal end of each handling beam on a support surface. A high side of each handling beam is defined facing an upward direction in which the reel support beam extends. For each frame assembly, the respective handle is mounted on and fixed to the high side of the handling beam.

For each of the two frame assemblies, the support axle can be releasably attached to the reel support beam by a first mounting ring mounted on the reel support beam.

For each of the two frame assemblies, the first mounting ring may be fixed to a distal end of the reel support beam opposite the proximal end thereof.

For each of the two frame assemblies, the first mounting ring may include a hollow circular cylinder mounted on and fixed to the reel support beam, the hollow circular cylinder having a longitudinal axis extending parallel to the support axle and perpendicular to the reel support beam.

For each of the two frame assemblies, the first mounting ring mounted on the reel support beam can be aligned across the space defined between the two frame assemblies with the first mounting ring on the reel support beam of the other frame assembly.

For each of the two frame assemblies, a second mounting ring may be mounted on the reel support beam aligned across the space defined between the two frame assemblies with a second mounting ring on the reel support beam of the other frame assembly.

For each of the two frame assemblies, a tubular foot may be fixed to the proximal end of the reel support beam to serve as a support fulcrum when tipping the apparatus, and stabilizing the apparatus in a standing position.

For each of the two frame assemblies, the tubular foot includes a hollow circular tube mounted on and fixed to a proximal terminus of the respective reel support beam, the hollow circular tube extending parallel to the support axle and perpendicular to the reel support beam.

A product according to at least one embodiment, to which the above examples and options apply, includes a package containing an apparatus in an unassembled condition, the apparatus for supporting and rolling a reel or spool when assembled. The apparatus includes: a first frame assembly in an unassembled condition, the first frame assembly including: a linear first handling beam defining a first longitudinal axis; a first handle rigidly fixed to the first handling beam offset from and perpendicular to the first longitudinal axis; a linear first reel support beam having a proximal end for attachment to the first handling beam and a distal end opposite the proximal end; a first foot fixed to the proximal end of the first reel support beam; and an axle mounting ring fixed to the first reel support beam and spaced from the proximal end thereof; a support axle for mounting a reel or spool thereon; a second frame assembly in an unassembled condition, the second frame assembly including: a linear second handling beam defining a second longitudinal axis; a second handle rigidly fixed to the second handling beam offset from and perpendicular to the second longitudinal axis; a linear second reel support beam having a proximal end for attachment to the second handling beam and a distal end opposite the proximal end; a second foot fixed to the proximal end of the second reel support beam; and an axle mounting ring fixed to the first reel support beam and spaced from the proximal end thereof.

The package can be shaped as a rectangular cuboid having no linear dimension along a side thereof greater than fifty eight inches.

The package can be shaped as a rectangular cuboid having a length of diagonal space no greater than sixty inches.

An apparatus for supporting and rolling a reel or spool, according to at least one embodiment, to which the above examples and options apply, includes two frame assemblies positioned side-by-side in the assembled condition of the apparatus, and a horizontal support axle for mounting a reel or spool thereon. The support axle connects the two frame assemblies and effects the apparatus when assembled as a generally rigid singular item. Each frame assembly includes a rigidly attached ergonomically oriented handle for tilting and generally handling the apparatus and any mounted reel, the handle extending horizontally and parallel to the axle. The handles transverse to the respective handling beams, at approximately ninety degrees and thus along a horizontal axis for intuitive gripping at any tilt position of the of the apparatus. The major movement freedom of the wrist, extension and flexion, can be utilized or a user's hand can comfortably let the handle rotate as the apparatus is tipped without necessitating complex wrist flexing in less strengthened rotations such as radial and ulnar.

The above summary is to be understood as cumulative and inclusive. The above and below described features are to be understood as combined in whole or in part in various embodiments whether expressly described herein or implied by at least this reference. For brevity, not all features are expressly described and illustrated as combined with all other features. No combination of features shall be deemed unsupported for merely not appearing expressly in the drawings and descriptions.

BRIEF DESCRIPTION OF THE DRAWINGS

The previous summary and the following detailed descriptions are to be read in view of the drawings, which illustrate some, but not all, embodiments and features as briefly described below. The summary and detailed descriptions, however, are not limited to only those embodiments and features explicitly illustrated.

DETAILED DESCRIPTIONS

Figure 1:
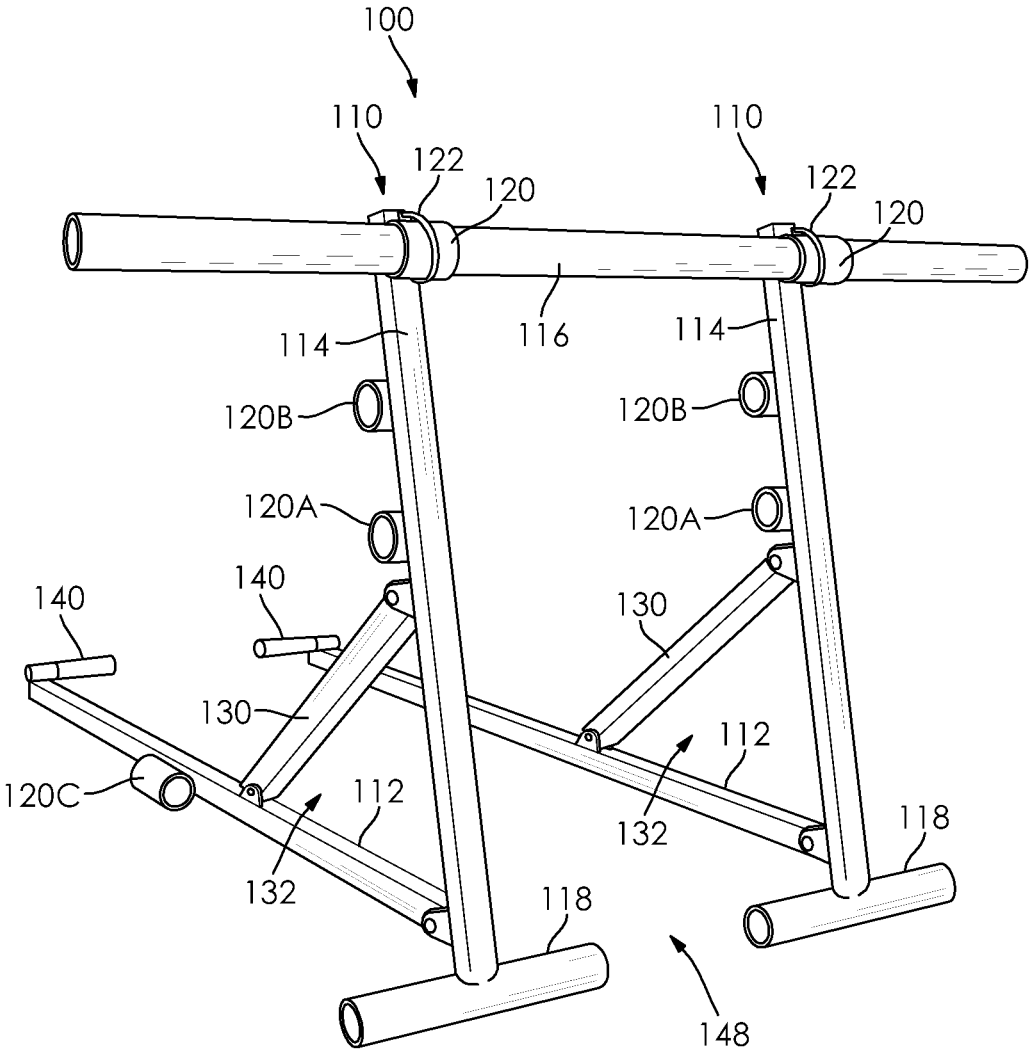
FIG. 1 is a perspective view of an inventive reel buck apparatus, according to at least one embodiment, in an assembled condition.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

Unless defined otherwise, technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a," "an," and "the" refer to "one or more" when used in the subject specification, including the claims. Unless indicated to the contrary, the numerical parameters set forth in the instant specification and attached claims are approximations that can vary depending upon the desired properties sought to be obtained within the scope of these descriptions. As used herein, the term "approximately," when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are within the scope of these descriptions.

An inventive reel carrier and stand apparatus 100, termed a reel buck, provides a quick and easy way to set up strand and cable reels, which may vary in diameter and weight. The apparatus can be assembled and disassembled, and can be stored, transported, and shipped in a space efficient essentially flat configuration. The apparatus is designed to be easily moved about a job site, handling the apparatus using ergonomically oriented handles while a mounted spool serves as a wheel. The reel buck is collapsible upon disassembly for quick loading and has multiple mounting positions to accommodate various spool sizes.

Figure 2:
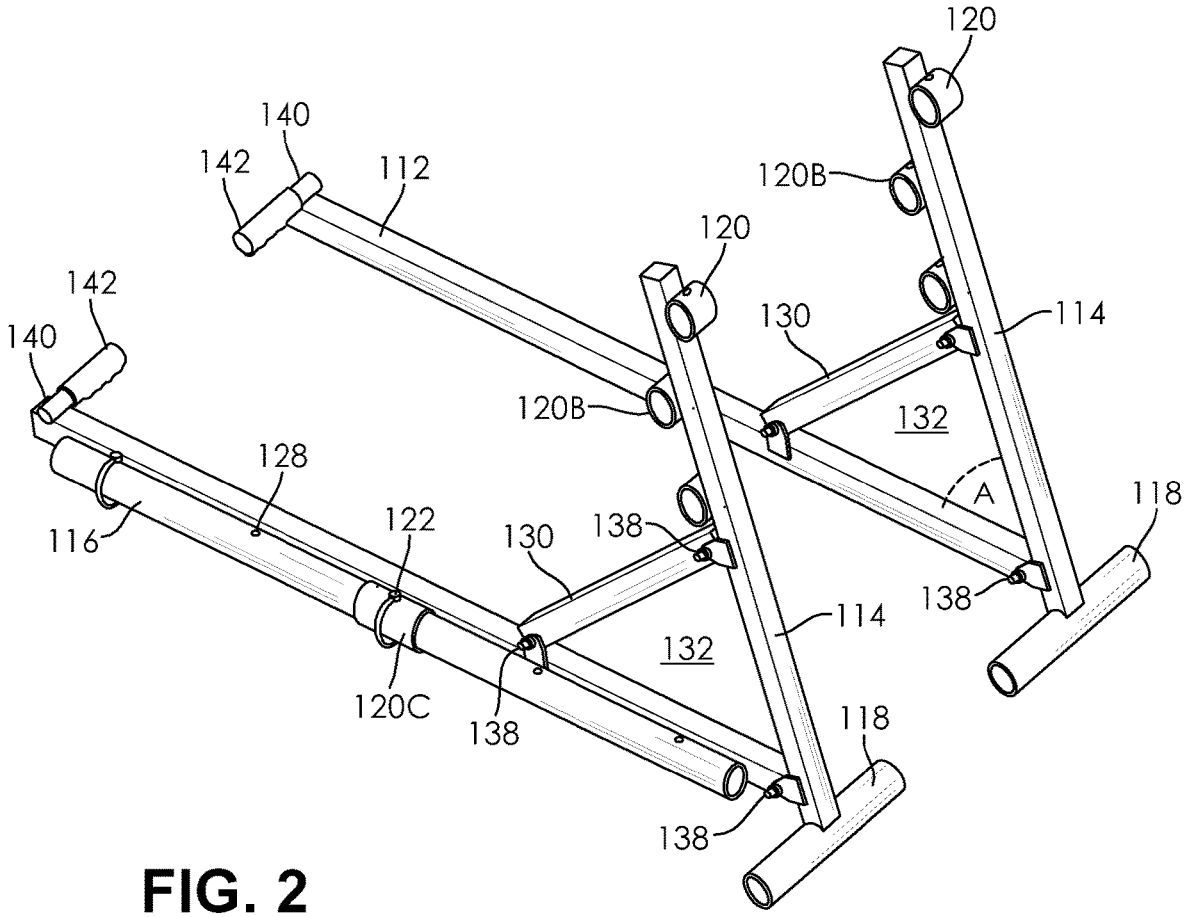
FIG. 2 is another perspective view of the apparatus of FIG. 1 in a partially disassembled condition.

The reel buck apparatus 100 has two frame assemblies 110 standing side-by-side in the assembled condition of the apparatus as in FIG. 1, and shown separate in FIG. 2. The two frame assemblies 110 have many similar and/or mirror-image like features for which a single description is sufficient. Each has a handling beam 112 and a reel support beam 114. The beams 112 and 114 are connected together at their respective proximal ends. In the assembled condition, each reel support beam 114, at or near its distal end, is coupled to a reel support axle 116, such that the axle effectively connects the two frame assemblies 110, effecting the apparatus 100 when assembled as a generally rigid singular item. A respective ergonomically oriented handle 140 is rigidly fixed, for example by welding, to the distal end of each handling beam 112.

Each of the two frame assemblies 110 includes a rigid truss bar 130, diagonally spanning and defining a triangular space 132 (FIG. 2) between proximal portions of the respective handling beam 112 and reel support beam 114. Opposing ends of each truss bar 130 are coupled to respective medial positions of a handling beam 112 and a reel support beam 114, thereby maintaining a predetermined and fixed relative angle A (FIG. 2), when assembled, between the linear handling beam 112 and linear support beam 114. The angle A is acute and shown as less than ninety degrees in the illustrated embodiment such that the reel support beam 114 leans over a proximal portion of the handling beam 112 when the reel buck apparatus 100 is in the reel stand position as in FIGS. 1 and 4B. This advantageously facilitates stability when a reel 50 is mounted by positioning its center of gravity over the handling beam 112.

Figure 3:
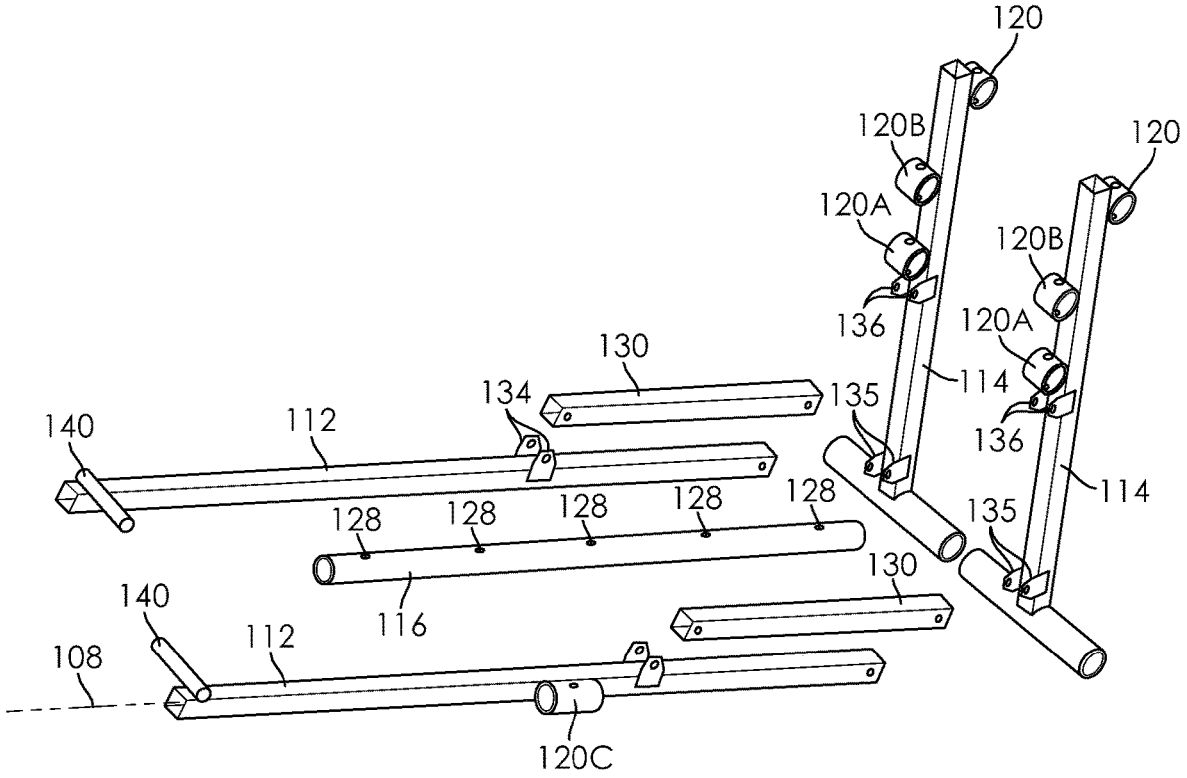
FIG. 3 is a perspective view of the apparatus of FIG. 1 in a highly disassembled condition.

The truss bar 130, with respective proximal portions of the handling beam 112 and reel support beam 114, defines a triangle frame for strength and stability. A holed first end of each truss bar 130 is connected to a respective handling beam 112 by paired and holed tabs 134 (FIG. 3) attached to and extending from the beam 112, for example welded thereto. A holed second end of each truss bar 130 is connected to a respective reel support beam 114 by paired and holed tabs 136 attached to and extending from the beam 114, for example welded thereto. The holed proximal end of the handling beam 112 is connected to the reel support beam 114 by paired and holed tabs 135 (FIG. 3) attached to and extending from the proximal end of the reel support beam 114, for example welded thereto. The connections are maintained by fasteners 138 such as bolts and nuts (FIG. 2). Other fastener types are within the scope of these descriptions. The handling beam 112, reel support beam 114, and truss bar 130, of each frame assembly 110 are positioned together in a plane. The plane so defined of each frame assembly 110 is laterally spaced from and parallel to the plane of the other.

Figure 4A:
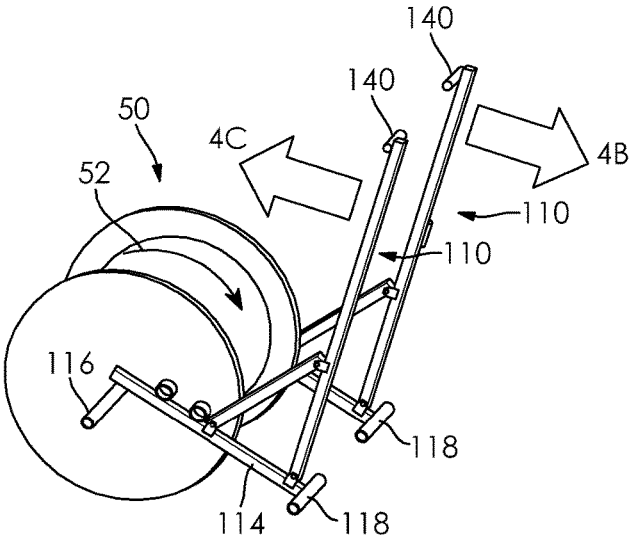
FIG. 4A is a perspective view of the apparatus of FIG. 1 shown in a position for mounting a reel.
Figure 4B:
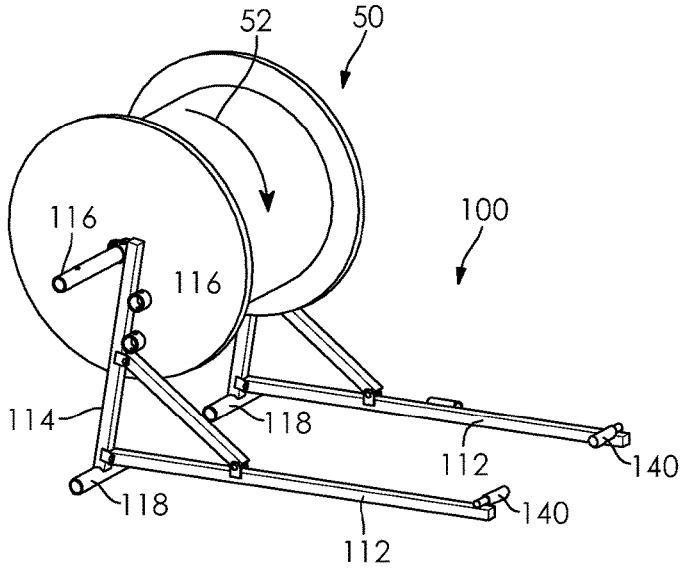
FIG. 4B is a perspective view of the apparatus and reel of FIG. 4A shown in a position for use of the reel buck apparatus as a reel stand.

A central portion of a respective tubular foot 118 is fixed to the proximal terminus of each reel support beam 114 to serve as a support fulcrum when tipping the apparatus, and stabilizing the apparatus 100 in the reel stand position as in FIGS. 1 and 4B. Each foot extends perpendicular to its attached support beam 114, and through the plane defined by the handling beam 112, reel support beam 114, and truss bar 133 of its respective frame assembly 110. Each foot is collinearly aligned with the other, and parallel to the axle in the assembled apparatus 100. Each foot 118 is illustrated as a hollow circular tube mounted on and fixed to the proximal terminus of the respective reel support beam 114, for example by welding, and having a longitudinal axis extending parallel to the axle axis and perpendicular to the linear reel support beam.

Figure 4C:
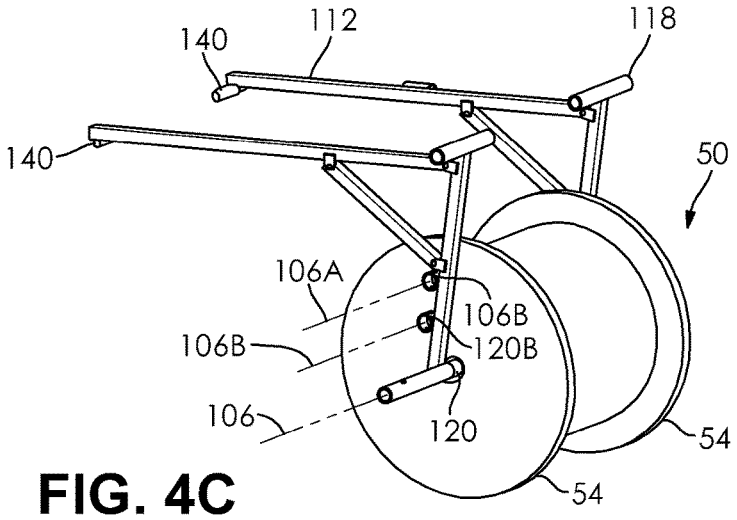
FIG. 4C is a perspective view of the apparatus and reel of FIG. 4A shown in a rolling position.
Figure 5:
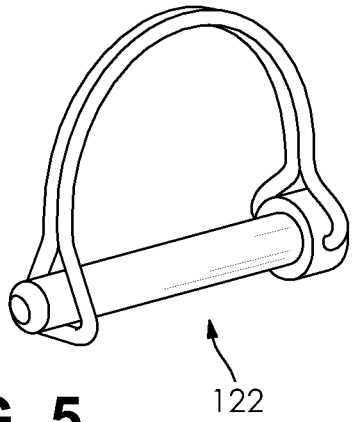
FIG. 5 shows an example of a clevis pin for use in mutually securing certain components of the reel buck apparatus of FIG. 1.

FIGS. 4A-4C show the reel buck apparatus 100 with a mounted reel 50. In FIG. 4A, the reel is supported by a support surface, with the reel buck apparatus 100 in an assembled condition. Support surface herein refers to a ground, a floor, a roof, a truck bed, a road, or other surface or structure over and by which the apparatus is positioned and supported. To achieve mounting and assembly, a worker stands or places the frame assemblies 110 each adjacent a respective side of the unmounted reel 50 and inserts the axle 116 through a selected axle mounting ring 120 on the reel support beam 114 of one of the two frame assemblies 110, then through the hub of the reel, and then through a corresponding mounting ring 120 on the reel support beam 114 of the other frame assembly 110. As shown in FIG. 1, the axle 116 is releasably fixed to each mounting ring 120 by a respective fastener 122 passed through aligned holes through the ring 120 and axle 116, to securely maintain the axle at the ring. The fasteners 122 are illustrated as clevis pins (FIG. 5), each having a shank and a releasable loop for securing the shank to a host structure. Other fastener types are within the scope of these descriptions. This effectively assembles the apparatus 100 as well as mounts the reel 50 onto the apparatus.

In FIG. 4B, the apparatus is shown with a mounted reel 50 for illustration of use of the apparatus as a reel stand. With the reel 50 mounted on the support axle 116, contents of the reel such as cable or line can be extended from the reel by rotation of the reel. The reel 50 should be mounted to assure its contents can be unwound from the reel by rotation of the reel as referenced as direction 52 in FIGS. 4A and 4B to assure against accidental tipping of the loaded apparatus when unwinding cable or line for use.

The apparatus and reel together can be tipped as represented in FIG. 4A, from the assembly position to the reel stand position of FIG. 4B, by pulling both handles 140 down until ends of the handling beams 112 reach the ground or other support surface. The contents of the reel 50 can be unwound from the position of FIG. 4B.

The reel buck assembly 100 can also be used to move the reel 50. To do this, from the position of FIG. 4A or FIG. 4B, a worker simply pushes on the handles 140 and/or the handling beams 112 up and over the reel 50 and beyond, until the disposition of FIG. 4C is reached, from which the reel 50 can be pushed around like a wheel barrow using the handling beams 112 and handles 140. In the rolling position (FIG. 4C), flanges 54 of the reel 50 contact the ground or other support surface, with reel then serving as a wheel for its own movement by use of the reel buck apparatus 100. Use on a horizontal support surface is suggested, especially where a loaded reel is heavy.

Various sized reels can be accommodated by multiple axle mounting positions defined by multiple pairs of axle mounting rings. The mounting rings are illustrated as hollow circular cylinders mounted on and fixed to the reel support beam, for example by welding, their longitudinal axes extending parallel to the axle axis and perpendicular to the linear reel support beam. Each mounting ring on the support beam 114 of each frame assembly 110 is paired with a respective corresponding mounting ring on the support beam 114 of the other frame assembly 110, the paired mounting rings being aligned across the space 148 (FIG. 1) defined between the two frame assemblies 110. As represented by dashed lines in FIG. 4C, any aligned pair of mounting rings so defined can support the axle in a horizontal disposition. In FIG. 1 the axle 116 is passed through a highest ring 120 on each reel support beam 114. Each reel support beam in the illustrated embodiment also has a lowest ring 120A, and an intermediate ring 120B, such that three aligned pairs are present: highest rings 120, intermediate rings 120B, and lowest rings 120A defining three heights or positions for the axle 116. This accommodates, in at least one embodiment of the apparatus 100, in order, reels up to fifty four inches in diameter, reels up to forty six inches in diameter, and reels up to thirty four inches in diameter.

A respective ergonomically oriented handle 140 is rigidly fixed to the distal end of each handling beam 112, for example welded to the beam, for tilting and generally handling the apparatus and any mounted reel as already described. The handles 140 are advantageously transverse to the respective handling beams, at approximately ninety degrees and thus along a horizontal axis for intuitive gripping at any tilt position of the of the apparatus 100. This is advantageous over prior reel lift devices in that the major movement freedom of the wrist, extension and flexion, can be utilized or a user's hand can comfortably let the handle rotate as the apparatus is tipped without necessitating complex wrist flexing in less strengthened rotations such as radial and ulnar. The orientation and mounting position of the handles 140 also promote safety, as the user's hands are not in the way of the apparatus being lowered when lowering the handling beams 112.

The handle 140 is mounted and fixed on the same side of its respective handling beam 112 as that to which the truss bar 130 is connected by the tabs 134, and that side generally facing the direction in which the linear reel support beams 114 extend. Thus, each handle 140 is offset from, and extends perpendicular to, the longitudinal axis 108 (FIG. 3) of the respective linear handling beam 112. This arranges the handles as parallel to the axle axis and as mounted on and fixed to the high sides of the handling beams 112 as the reel stand position of FIG. 4B is approached, providing some space between the ground or other support surface and handles 140 when contact occurs, minimizing the likelihood of hand injury and permitting convenient space for grasping and the lifting the handles when needed. Each handle 140 is illustrated in FIG. 2 as a tubular rigid core bar having a polymer ergonomic sleeve 142. The sleeve 142 has finger detents for grip and intuitive handling. The handles 140 extend inward toward each other, into the space 148 (FIG. 1) defined between the two frame assemblies 110, each from a respective distal end of a handling beam, in the assembled illustrated embodiment. This further protects hands from brushing or impacting nearby structures when moving a reel, for example through narrow gates or other routes through construction sites.

As shown and described, the reel buck apparatus 100 is adjustable for different reel widths by adjustment of the mounting rings 120 (120A, 120B) along the axle 116. The axle has multiple transverse through holes 128 (FIG. 3) for alignment with any selected mounting ring and attachment thereto by use of fasteners 122. As shown in FIG. 2, when not in use, the axle 116 can be stowed along a first handling beam 112 by a particular mounting ring, referenced as 120C (FIGS. 1-2), which is mounted on and fixed to a side of the handling beam opposite the space 148, and along a mid portion of the handling beam, for example by welding.

Figure 6:
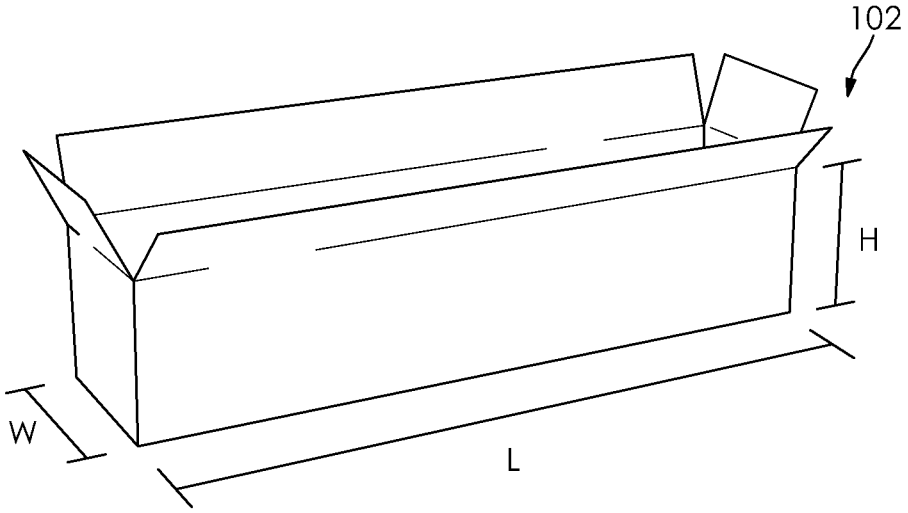
FIG. 6 is a perspective view of a shipping box, according to at least one embodiment, for use with the inventive reel buck apparatus when in a disassembled condition for shipping and/or storage.

The reel buck apparatus 100 is adjustable for different reel diameters and/or preferred working heights by choice of which aligned pair of mounting rings (120, 120A, 120B) support the axle 116, each pair defining a respective axle axis (106, 106A, 106B, FIG. 4C) when assembled. In at least one embodiment, the beams, axle and truss bars are made of durable steel, in tubular form, providing a weight capacity of one thousand pounds to withstand the toughest job sites. The reel buck apparatus, in at least one example, weighs less than seventy pounds, and in a flat-packed configuration such as for shipping has dimensions: less than 48 inches on its longest side; less than 30 inches on its second longest side; and length plus girth is less than one hundred and thirty inches. An exemplary shipping package 102, illustrated as a box, is sufficiently dimensioned to contain the reel buck apparatus 100 in a disassembled flat-packed configuration is shown in FIG. 6. In a non-limiting example the box 102 has a length L of approximately fifty seven inches, a width W of approximately seven inches, and a height H of approximately thirteen and half inches. Other dimensions are within the scope of these descriptions.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. An apparatus for supporting and rolling a reel or spool, the apparatus comprising:

two frame assemblies positioned side-by-side in an assembled condition of the apparatus;

a support axle for mounting a reel or spool thereon, the support axle attached to each one of the two frame assemblies;

wherein each frame assembly comprises a rigidly fixed handle for tilting and handling the apparatus, each said handle extending parallel to the support axle;

wherein each said handle extends into a space defined between the two frame assemblies and spanned by the support axle;

wherein each of the two frame assemblies comprises a handling beam to which the respective handle is rigidly fixed, and a reel support beam to which the support axle is attached, and to which the handling beam is connected:

wherein for each of the two frame assemblies, the handling beam has a proximal end connected to a proximal end of the reel support beam, and a distal end to which the respective handle is rigidly fixed;

wherein for each of the two frame assemblies, the respective handle is rigidly fixed on a side of the handling beam facing a direction in which the reel support beam extends;

wherein for each of the two frame assemblies, the respective handle is offset from, and extends perpendicular to, a longitudinal axis of the handling beam; and wherein the apparatus has a standing position in which:

the apparatus is supported at least in part by the distal end of each handling beam on a support surface;

a high side of each handling beam is defined facing an upward direction in which the reel support beam extends; and for each frame assembly, the respective handle is mounted on and fixed to the high side of the handling beam.

2. The apparatus of claim 1, wherein each said handle extends toward the other said handle.

3. The apparatus of claim 1, wherein for each of the two frame assemblies, an acute angle is defined between the handling beam and the support beam.

4. The apparatus of claim 1, wherein each of the two frame assemblies includes a rigid truss bar diagonally spanning a space between medial portions of the handling beam and the reel support beam.

5. The apparatus of claim 1, wherein for each of the two frame assemblies, the support axle is releasably attached to the reel support beam by a first mounting ring mounted on the reel support beam.

6. The apparatus of claim 5, wherein for each of the two frame assemblies, the first mounting ring is fixed to a distal end of the reel support beam opposite the proximal end thereof.

7. The apparatus of claim 5, for each of the two frame assemblies, the first mounting ring comprises a hollow circular cylinder mounted on and fixed to the reel support beam, the hollow circular cylinder having a longitudinal axis extending parallel to the support axle and perpendicular to the reel support beam.

8. The apparatus of claim 7, wherein for each of the two frame assemblies, the first mounting ring mounted on the reel support beam is aligned across the space defined between the two frame assemblies with the first mounting ring on the reel support beam of the other frame assembly.

9. The apparatus of claim 8, wherein for each of the two frame assemblies, a second mounting ring mounted on the reel support beam is aligned across the space defined between the two frame assemblies with a second mounting ring on the reel support beam of the other frame assembly.

10. The apparatus of claim 1, wherein for each of the two frame assemblies, a tubular foot is fixed to the proximal end of the reel support beam to serve as a support fulcrum when tipping the apparatus, and stabilizing the apparatus in a standing position.

11. The apparatus of claim 10, wherein for each of the two frame assemblies, the tubular foot comprises a hollow circular tube mounted on and fixed to a proximal terminus of the respective reel support beam, the hollow circular tube extending parallel to the support axle and perpendicular to the reel support beam.

* * * * *